US005607355A

United States Patent [19]

Van Becelaere

[11] Patent Number: 5,607,355

[45] Date of Patent: Mar. 4, 1997

[54] MOUNTING BRACKET FOR DAMPER

[75] Inventor: Robert M. Van Becelaere, Lake Lotawana, Mo.

[73] Assignee: Tomkins Industries, Inc., Dayton, Ohio

[21] Appl. No.: 567,307

[22] Filed: Dec. 5, 1995

[51] Int. Cl.[6] ..... F24F 11/053

[52] U.S. Cl. ..... 454/369; 285/189

[58] Field of Search ..... 160/1; 285/189; 454/257, 270, 271, 272, 273, 274, 369

[56] References Cited

U.S. PATENT DOCUMENTS

| | | | |
|---|---|---|---|
| 2,771,020 | 11/1956 | Shanahan | 454/273 |
| 3,800,846 | 4/1974 | Kurz | 160/1 X |
| 3,917,323 | 11/1975 | Morgan | 285/189 |
| 3,988,030 | 10/1976 | Twedell | 285/189 X |
| 4,446,667 | 5/1984 | Hertel . | |
| 4,515,068 | 5/1985 | Van Becelaere . | |
| 4,524,678 | 6/1985 | Klebanoff . | |
| 4,911,065 | 3/1990 | Van Becelaere . | |

FOREIGN PATENT DOCUMENTS

| | | | |
|---|---|---|---|
| 982901 | 2/1976 | Canada | 160/1 |

*Primary Examiner*—Harold Joyce
*Attorney, Agent, or Firm*—Shook, Hardy & Bacon L.L.P.

[57] ABSTRACT

A mounting bracket for securing a damper in an opening formed in a wall includes four generally L-shaped segments surrounding the damper sleeve. Each segment has a generally planar wall-engaging plate and a generally planar sleeve-engaging plate. The wall-engaging plate and the sleeve-engaging plate form the L-shape of the segment. Each segment also includes a land extending generally perpendicular to the wall-engaging plate. Two of the segments are end segments and the other two of the segments are intermediate segments. The land of each end segment is connected to the land of its adjacent intermediate segment and the lands of the intermediate segments are connected together. The segments can be removed from and replaced around the damper sleeve by bending of the land connections between the segments.

8 Claims, 1 Drawing Sheet

MOUNTING BRACKET FOR DAMPER

This invention relates generally to fire and smoke dampers and, more specifically, to mounting brackets for positioning dampers structure.

Dampers are required by building codes at prescribed intervals in most buildings. Certain zones of the building are typically isolated from other zones by fire retardant walls and the like to assist in the control of fire in the building. Passages through the fire wall which cannot be physically closed during normal use of the building, such as air conditioning and heating ducts for example, are provided with protective dampers. The dampers normally remain in a standby condition to permit fluids to flow through the building. In the event of a fire, these dampers automatically operate to close the fluid flow through the passage.

Many building codes require or customers insist that these emergency protective devices and the mode of their installation in the building be certified by an appropriate testing organization. One of the tests deemed relevant by one or more of the principal testing organizations concerned with such matters involves the application of a stream of water under high pressure against the test device when the latter has been subjected to a predetermined amount of heat from a fire for a predetermined length of time. Such streams are used to simulate the explosive forces associated with a fire and the test is designed to ensure that a stream from a fire hose would not destroy the effectiveness of the damper.

Since the damper often must be telescoped through a passageway in a wall and mated with ends of proximal duct work, it is usually not possible to install mounting structures on the damper until it is positioned in its final location. More specifically, a damper normally has a sleeve which is telescoped through a wall passageway. The passageway typically is larger than the sleeve to allow for outward expansion of the sleeve and damper. After the damper sleeve has been slid into place, mounting flanges are attached to each side of the sleeve and abut against the wall surface to prevent movement of the damper in the passageway. Because the sleeve usually is rectangular and flanges are required for each side of the wall, the installation of the damper sleeve requires the attachment of eight separate flanges to the sleeve (i.e., four flanges on one side of the wall and four flanges on the other side). The flanges themselves only abut against the wall surface but are not attached thereto so that expansion of the sleeve and damper are allowed. The four flanges used on one side of the wall can be constructed with slanted edges so that when mounted on the sleeve, the slanted edges of one flange will mate with the slanted edges of adjacent flanges in a picture frame fashion.

Typically, when dampers are shipped to a worksite, the mounting flanges are separate from the damper sleeve. Therefore, many times at a worksite numerous dampers are stored at one location, and an adjacent pile of mounting flanges can be found adjacent the location with all the different mounting flanges mixed up in the pile. This presents numerous problems for construction workers. First, oftentimes the individual mounting flanges are mistaken for pieces of scrap metal and inadvertently discarded. Therefore, it is not unusual for the mounting flanges to be replaced even before they are installed on the damper. Further, because flanges of different sizes may be thrown into a single pile, it often requires tedious and time-consuming effort on the part of a worker to first locate the proper size of flange, and then attach eight separate flanges to install one damper.

Attempts have been made to provide an integral rectangular-shaped one-piece flange which surrounds the damper sleeve. For this rigid one-piece structure to be installed, it had to be attached to the damper sleeve prior to the damper sleeve being connected to the associated ductwork because the flange was a completely closed rectangle. Further, a major disadvantage of this solid one-piece construction was that the edges of the flange segments, which were welded together to form the overall rectangular shape, did not allow for expansion of the sleeve when subjected to heat. More specifically, the solid rectangular flange surrounding the damper sleeve would not expand sufficiently when subjected to the extreme heat often associated with fires, thus raising the possibility of damper failure.

Therefore, a mounting construction is needed which alleviates the problems of the conventional mounting structures discussed above.

Accordingly, it is a primary object of the present invention to provide a mounting bracket for a damper which is of a one piece deformable construction to allow easy positioning of the bracket about the sleeve of the damper.

A further important object of this invention is to provide a mounting bracket that is less likely to be lost at the job site because it is of a one piece construction.

An additional object of this invention is to provide a one piece mounting bracket which will meet fire standards regarding the expansion of the fire assembly.

These and other important aims and objectives of the present invention will be further described, or will become apparent from the following description and explanation of the drawings, wherein.

Figure 4:
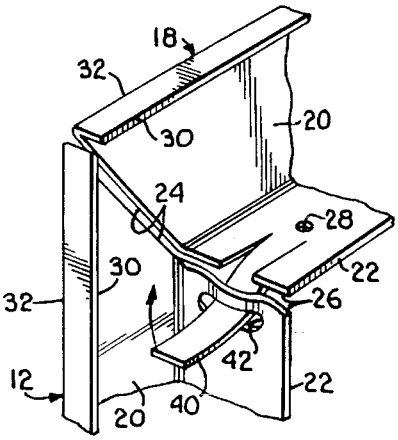
Figure 5:
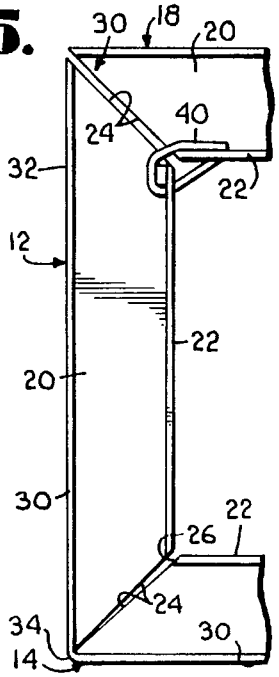

FIG. 4 is an enlarged, fragmentary top perspective view of two end segments of the mounting bracket of this invention, and showing the structure used to connect the end segments together to form the generally rectangular shape of the mounting bracket; and FIG. 5 is an enlarged, fragmentary top plan view of the mounting bracket of this invention showing the mounting bracket in its closed rectangular orientation.

Figure 1:
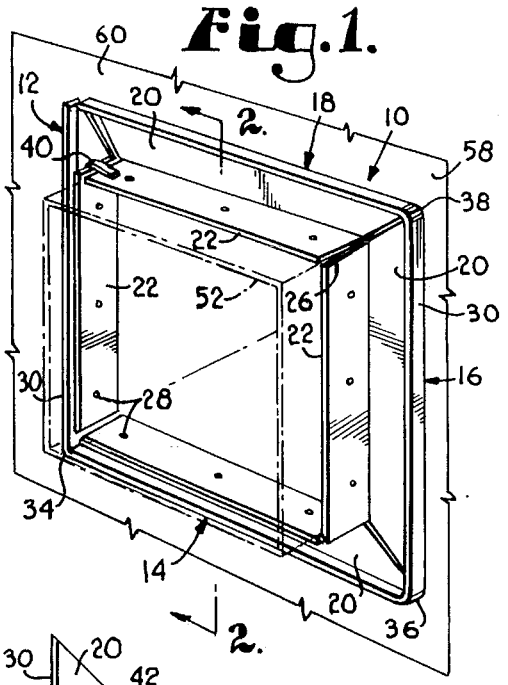
FIG. 1 is a top perspective view of a mounting bracket embodying the principles of this invention partially installed around a damper and adjacent a wall, the sleeve of the damper shown in phantom lines.

A damper mounting bracket embodying the principles of this invention is broadly designated by the reference numeral 10. Bracket 10 has four separate segments 12, 14, 16 and 18. Segments 12, 14, 16 and 18 serve to form the generally rectangular shape of bracket 10 and completely surround the top, bottom and sides of a damper sleeve, as best shown in FIG. 1 and as will be more fully described below.

Each of segments 12, 14, 16 and 18 has a plate 20 for engaging the wall through which a damper is disposed and a generally planar plate 22 for engagement and attachment to a damper sleeve. Wall plate 20 and sleeve plate 22 are oriented with respect to each other at 90° to form the general L-shape of each segment. Plate wall 20 of each segment has a slanted edge 24 on each end. When bracket 10 is folded into its rectangular shape, each slanted edge will lie adjacent to and mate with the slanted edge of an adjoining segment so that wall plates 20 are oriented in a picture frame fashion as best shown in FIGS. 1 and 5.

Each sleeve plate 22 has opposite generally straight edges 26 which lie adjacent to straight edges of adjoining segments when the bracket is folded into its rectangular orientation. Each sleeve plate 22 also has attaching holes 28 which are used to secure bracket 10 to the damper sleeve in a manner that will be more fully described below.

A land 30 is formed on each of segments 12, 14, 16 and 18. Each land 30 extends upwardly from an outer edge 32 of the plate wall of the respective segment. Further, each land 30 is generally perpendicular to its respective plate wall 20.

Figure 3:
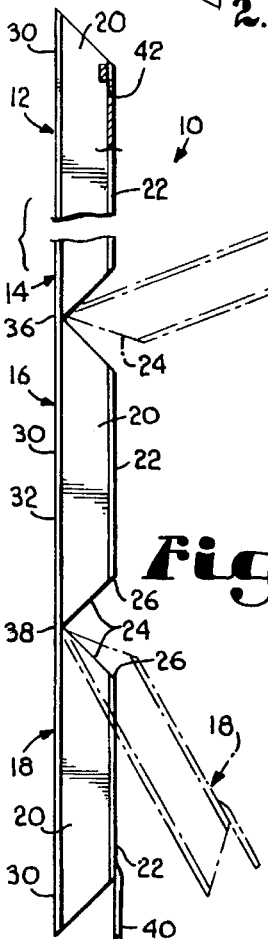
FIG. 3 is a fragmentary top plan view of the mounting bracket shown in FIG. 1, the mounting bracket shown in an unfolded open position, the deformability of the mounting bracket shown in phantom lines.

As best shown in FIGS. 1, 3 and 5, segments 12 and 18 are end segments of bracket 10 and segments 14 and 16 are intermediate segments. Land 30 of segment 12 is formed integrally with land 30 of segment 14 so that a fold area 34 is formed between the segments. Further, land 30 of segment 14 is formed integrally with land 30 of segment 16 so that fold area 36 is formed. Lastly, land 30 of segment 16 is formed integrally with land 30 of segment 18 so that fold area 38 is formed. Segments 12, 14, 16 and 18 are only connected together at fold areas 34, 36 and 38. Thus, fold areas 34, 36 and 38 allow bracket 10 to be positionable between an "open orientation" wherein end segments 12 and 18 are not connected and a "closed orientation" that forms a closed rectangular shape. More specifically, each segment 12, 14, 16 and 18 can be moved or deformed with respect to the adjoining segment because of the provision of the fold areas as shown in phantom lines in FIG. 3.

Edge 26 of end segment 18 has a bendable tang 40 formed integrally therewith. Tang 40 is capable of engaging an aperture 42 formed adjacent the edge 26 of end segment 12. To hold bracket 10 in its generally rectangular closed orientation, tang 40 is bendably positioned through aperture 42 and doubled over as best shown in FIGS. 4 and 5.

Bracket 10 is preferably formed from a single piece of sheet metal. More specifically, the bracket can be formed by first bending an elongated piece of sheet metal into an L-shape. Thereafter, one of the legs of the L-shape can be bent to form a single elongated land along the metal piece. The elongated piece of bent metal can then be cut to form the slanted edges 24, and thus, define each of segments 12, 14, 16 and 18. The elongated piece of metal, however, is not cut through the one-piece land so that the fold areas between the segments are formed.

Figure 2:
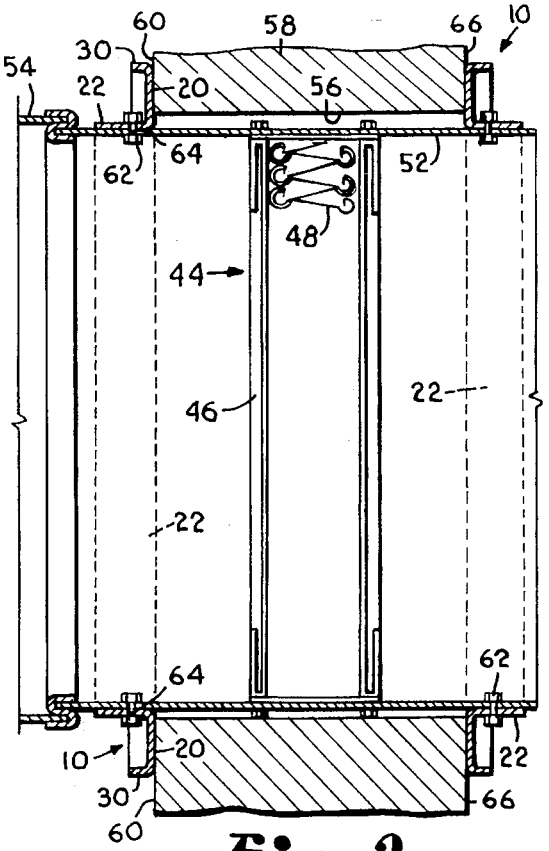
FIG. 2 is an enlarged, detailed cross-sectional view taken generally along lines 2—2 of FIG. 1 showing the damper disposed in a wall utilizing two mounting brackets of the present invention, the damper shown in its open standby position.

With reference to FIGS. 1 and 2, the installation of bracket 10 around a damper 44 will be described. Damper 44 includes a frame 46 and a barrier 48 mounted to frame 46 and adapted to move across the opening defined by the frame to block the flow of fluid through the damper opening. Barrier 48, which may be in the nature of a screen comprised of a plurality of pivotally connected blades, is held in a standby position by a fusible link (not shown). The fusible link is constructed of a eutectic material having the property of melting when the ambient temperature reaches a predetermined critical level, whereupon barrier 48 is permitted to move under the influence of springs (not shown) across the damper opening to terminate the fluid flow through the damper. Attached to and surrounding frame 46 is a generally rectangular damper sleeve 52 configured to mate with the heating and air conditioning ducts 54 for conducting fluid through the damper opening.

Damper 44 is installed by first telescopically positioning sleeve 52 through rectangular hole 56 formed in wall 58. Hole 56 is slightly larger than sleeve 52 to allow expansion of damper 44 when subjected to extreme heat. If damper 44 is not allowed to expand, the damper and/or wall may fail. After damper 44 is positioned in the wall, sleeve 52 can then be attached to ducts 54. Bracket 10 can then be positioned around sleeve 52 by bending of the segments relative to one another about fold areas 34, 36 and 38 so that plate walls 20 engage surface 60 of wall 58 and so that sleeve plates 22 are positioned along their respective sides of sleeve 52. More specifically, segment 18 is positioned on the top of sleeve 52, segment 14 on the bottom, and segments 12 and 16 on the sides. Tang 40 is positioned through aperture 42 to hold the segments in their rectangular closed orientation. Plates 22 are then attached to their respective surface of sleeve 52 by positioning fasteners 62 through holes 28 in the plates and through holes 64 formed in the sleeve surfaces. An additional bracket 10 is also positioned adjacent the other surface 66 of wall 58 in the same manner. As is apparent, once the brackets 10 are positioned adjacent their respective surfaces, lateral movement of the damper is prevented. However, because brackets 10 are not fixedly attached to the surfaces of wall 58, the damper can expand within hole 56.

It has been found that the construction of bracket 10 such that segments 12, 14, 16 and 18 are connected only by the minuscule material found in fold areas 34, 36 and 38 allows damper 44 to expand the necessary amount to prevent failure. More specifically, by not securing the bracket segments together along their slanted edges 24 or their straight edges 26, but only at the fold areas, bracket 10 will allow expansion of damper 44 when subjected to extreme heat. In fact, as damper 44 expands when subjected to high temperatures, the minuscule amount of material found in the fold areas oftentimes will simply break, thus allowing totally uninhibited expansion of the damper. The positioning of lands 30, and thus the fold areas, perpendicular to wall plates 20 allows the bracket to be advantageously bent between its "open orientation" and its "closed orientation." More specifically, the material in the fold areas allows the bracket to be deformed a suitable number of times between its open and closed orientations to allow its attachment to the damper.

Bracket 10 can be shipped in its closed position attached to its associated damper sleeve 52. After the damper unit reaches a job site, the bracket can be easily removed from around the sleeve. After the bracket is removed from the sleeve, all the segments 12, 14, 16 and 18 remain attached together and in a single unit instead of forming a pile of disassociated members. After the damper is positioned in the wall, bracket 10 can then be attached in the manner described above. Thus, bracket 10 prevents the different mounting segments needed for each of the sides of a particular damper from being separated from one another. Further, the bracket ensures that the right sized segments will remain in one convenient unit at all times. Additionally, the connected configuration of the segments reduces the possibility of a worker mistaking the bracket for scrap metal, and thus, inadvertently discarding the bracket.

Bracket 10 can be held to the shipped damper by simply attaching one of the segments of the bracket with one or more fasteners 62 to the damper sleeves. The integral arrangement of bracket 10 in its closed position with tang 40 engaging aperture 42 will hold the rest of the segments to the damper unit. Therefore, instead of requiring the detachment of numerous individual segments from the damper sleeve after it has arrived at the job site and prior to it being positioned in the wall, the integral segments can be easily removed by detaching one or two fasteners from one of the segments.

Having described the invention, what is claimed:

1. A mounting bracket for securing a damper in an opening formed in a wall, the damper having a generally rectangular-shaped sleeve extending through the opening, the bracket comprising:

four generally L-shaped segments surrounding the damper sleeve, each segment having a generally planar wall-engaging plate and a generally planar sleeve-engaging plate, said wall-engaging plate and said sleeve-engaging plate forming the L-shape of the segment, each segment also having a land extending generally perpendicular to said wall-engaging plate, wherein two of said segments are end segments and the other two of said segments are intermediate segments, said land of each end segment connected to said land of its adjacent intermediate segment and said lands of said intermediate segments connected together, and wherein said segments can be removed from and replaced around the sleeve by bending of the land connections between the segments.

2. The mounting bracket of claim 1 wherein each land of each segment is disposed adjacent an edge of said wall-engaging plate that is opposite to said sleeve-engaging plate.

3. The mounting bracket of claim 2 wherein each land extends the entire length of its respective segment.

4. The mounting bracket of claim 1 wherein both ends of each wall-engaging plate of each segment are angular so that when said segments surround said sleeve, each end of each wall plate will mate with the end of an adjacent wall plate in a picture frame fashion.

5. The mounting bracket of claim 1 wherein one of said end segments has a bendable tang disposed adjacent one end of its sleeve plate and the other end segment has an aperture formed adjacent one end of its sleeve plate, said tang capable of engaging said aperture to hold said segments in a generally rectangular configuration.

6. The mounting bracket of claim 1 further comprising means for connecting said sleeve plates to the sleeve.

7. The mounting bracket of claim 1 wherein each land of each segment extends away from the wall when said bracket is disposed around the sleeve.

8. The mounting bracket of claim 1 wherein said segments are all formed from a single integral piece of material.

* * * * *